US006360919B1

(12) United States Patent
Brule

(10) Patent No.: US 6,360,919 B1
(45) Date of Patent: Mar. 26, 2002

(54) FLUID PRODUCT DISPENSING DEVICE

(75) Inventor: François Brule, Pacy-sur-Eure (FR)

(73) Assignee: Valois S.A., Neubourg (FR)

( * ) Notice: Subject to any disclaimer, the term of this patent is extended or adjusted under 35 U.S.C. 154(b) by 0 days.

(21) Appl. No.: 09/744,764

(22) PCT Filed: Jul. 28, 1999

(86) PCT No.: PCT/FR99/01855

§ 371 Date: Jan. 30, 2001

§ 102(e) Date: Jan. 30, 2001

(87) PCT Pub. No.: WO00/07738

PCT Pub. Date: Feb. 17, 2000

(30) Foreign Application Priority Data

Jul. 31, 1998 (FR) ..... 98 10033

(51) Int. Cl.[7] ..... B67D 5/58

(52) U.S. Cl. ..... 222/189.09; 222/189.11; 222/321.9

(58) Field of Search ..... 222/189.09, 189.11, 222/321.9, 385

(56) References Cited

U.S. PATENT DOCUMENTS

| | | | | |
|---|---|---|---|---|
| 4,093,124 A | * | 6/1978 | Morane et al. | 222/189.09 |
| 5,431,310 A | | 7/1995 | Kanner et al. | |
| 5,727,715 A | | 3/1998 | McKenna et al. | |
| 5,752,629 A | | 5/1998 | Hardy | |
| 5,829,645 A | * | 11/1998 | Hennemann | 222/189.11 |
| 5,927,559 A | * | 7/1999 | Bommer et al. | 222/321.9 |

FOREIGN PATENT DOCUMENTS

| | | |
|---|---|---|
| EP | 771 734 | 5/1997 |
| WO | WO98/48943 | 11/1998 |

* cited by examiner

*Primary Examiner*—Philippe Derakshani
(74) *Attorney, Agent, or Firm*—Sughrue Mion, PLLC

(57) ABSTRACT

A fluid dispenser device includes a fluid tank, a dispensing pump (10) operating without air intake, a turret (20) supporting and fixing the pump (10), the turret being fixed on the tank by a fixing ring (30), the device being characterized in that at least a portion (21) of the turret (20) is made of a plastics material that is permeable to air.

7 Claims, 3 Drawing Sheets

FLUID PRODUCT DISPENSING DEVICE

FIELD OF THE INVENTION

The present invention relates to a fluid dispenser device, and more particularly to such device operating with a pump having no air intake.

It is well known, particularly in the fields of pharmacy, cosmetics, or perfumery, to make fluid dispenser devices comprising a tank containing the fluid, in general a liquid, and a pump, said pump being fixed on said tank by means of a turret and/or a fixing ring. Generally, to avoid contaminating the fluid contained in the tank, the pump operates without intake of air, but under such circumstances there is the problem of suction being created inside the tank.

BACKGROUND OF THE INVENTION

To resolve this problem, proposals have been made in particular to allow air to pass between the outside of the device and the tank, with a filter being interposed to filter any contaminating agents, and in particular bacteria. Devices of that type are described in particular in documents EP-0 189 549 and EP-0 800 869. The main drawback of that type of device is that it requires a filter to be manufactured and installed between said tank and the opening to the atmosphere, and that considerably complicates manufacture and assembly of the device with harmful consequences for the final cost. In addition, that type of system is not always easy to adapt to commonly-used standard pumps.

Documents US-5 752 629, US-5 431 310, and WO 98/48943 also disclose filter elements assembled at vent holes.

Another solution is proposed in document EP-0 771 734. In that document, it is proposed to make all or part of the tank containing the fluid out of a material that is permeable to air. The main drawback of that device is that it requires a special tank to be manufactured with appropriate materials, thereby considerably increasing the cost of said tank, and above all it does not enable tanks of any type to be used or tanks made of any material, in particular those that are in widespread use at present.

SUMMARY OF THE INVENTION

An object of the present invention is to provide a fluid dispenser device which does not reproduce the drawbacks mentioned above.

An object of the present invention is thus to provide a fluid dispenser device that operates using a pump without air intake, known as an "airless" pump, said device enabling the suction inside the tank to be balanced without contaminating the fluid remaining in the tank and without complicating manufacture and assembly of the device, and consequently without making it more costly.

Another object of the present invention is to provide a fluid dispenser device which operates effectively with any type of tank, of any shape or material.

Another object of the invention is to provide such a fluid dispenser device which prevents the fluid contained in the tank from being spoilt while guaranteeing that it is properly dispensed on each actuation.

The present invention thus provides a fluid dispenser device comprising a fluid tank, a dispenser member such as a pump operating without air intake, a turret supporting and fixing said pump, said turret being fixed on said tank by a fixing ring, at least a portion of said turret being made of a plastics material that is permeable to air.

In a particular embodiment of the invention, said turret is made integrally with said fixing ring.

Preferably, the air-permeable plastics material allows air to pass to the inside of the tank but prevents the passage of bacteria.

Advantageously, the air-permeable plastics material comprises thermoplastic polymers.

Preferably, the air-permeable plastics material includes a filler.

Advantageously, the filler is chalk, talc, or silicone. dr

BRIEF DESCRIPTION OF THE DRAWING

In an advantageous embodiment, said turret has a window of air-permeable plastics material, said window being overmolded in said turret which is made of a material that is not permeable. Other characteristics and advantages appear from the following detailed description given by way of non-limiting example and with reference to the accompanying drawings, in which.

Figure 2:
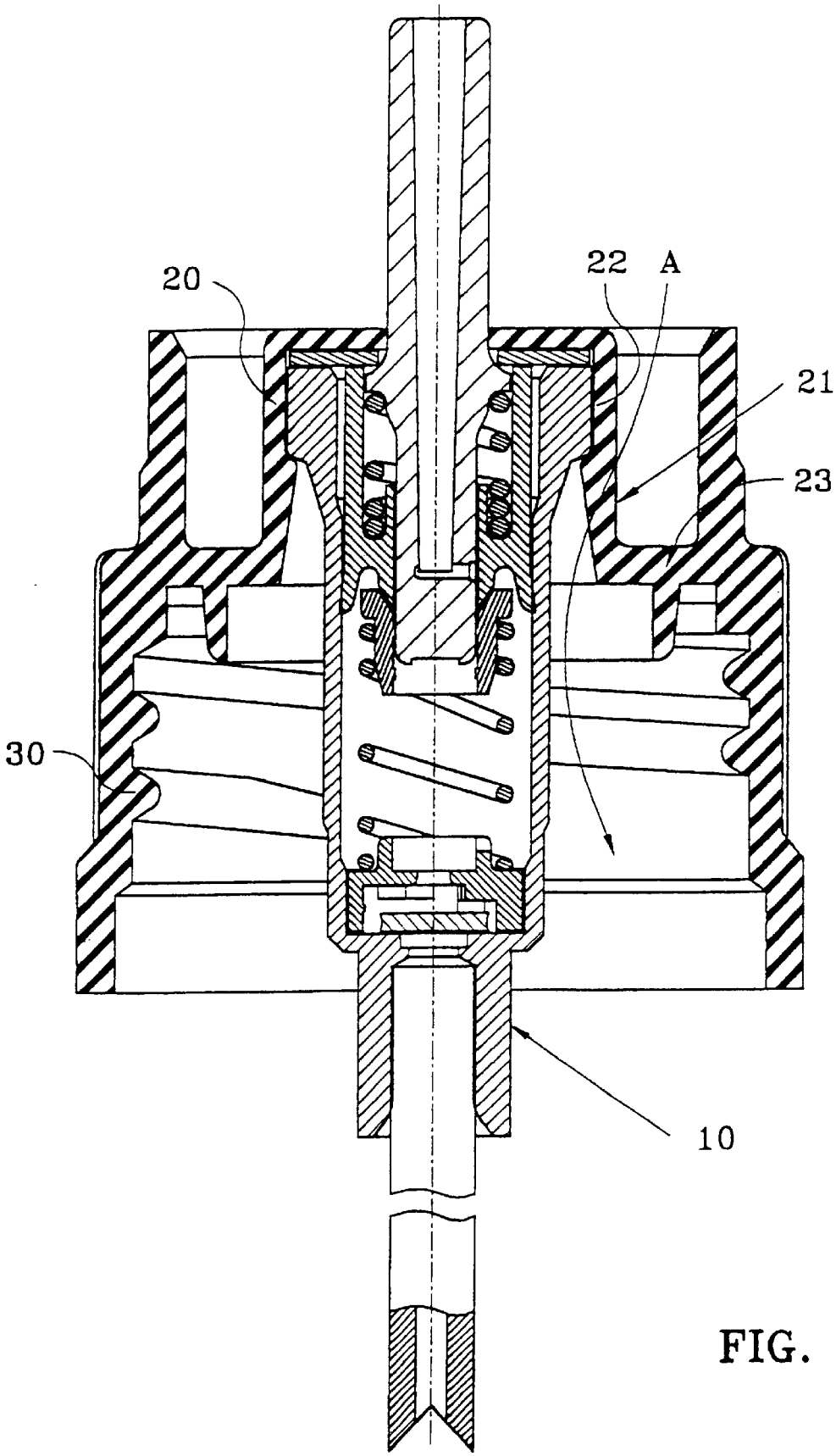
FIG. 2 is a view similar to FIG. 1 showing a second embodiment of a turret of the present invention.
Figure 3:
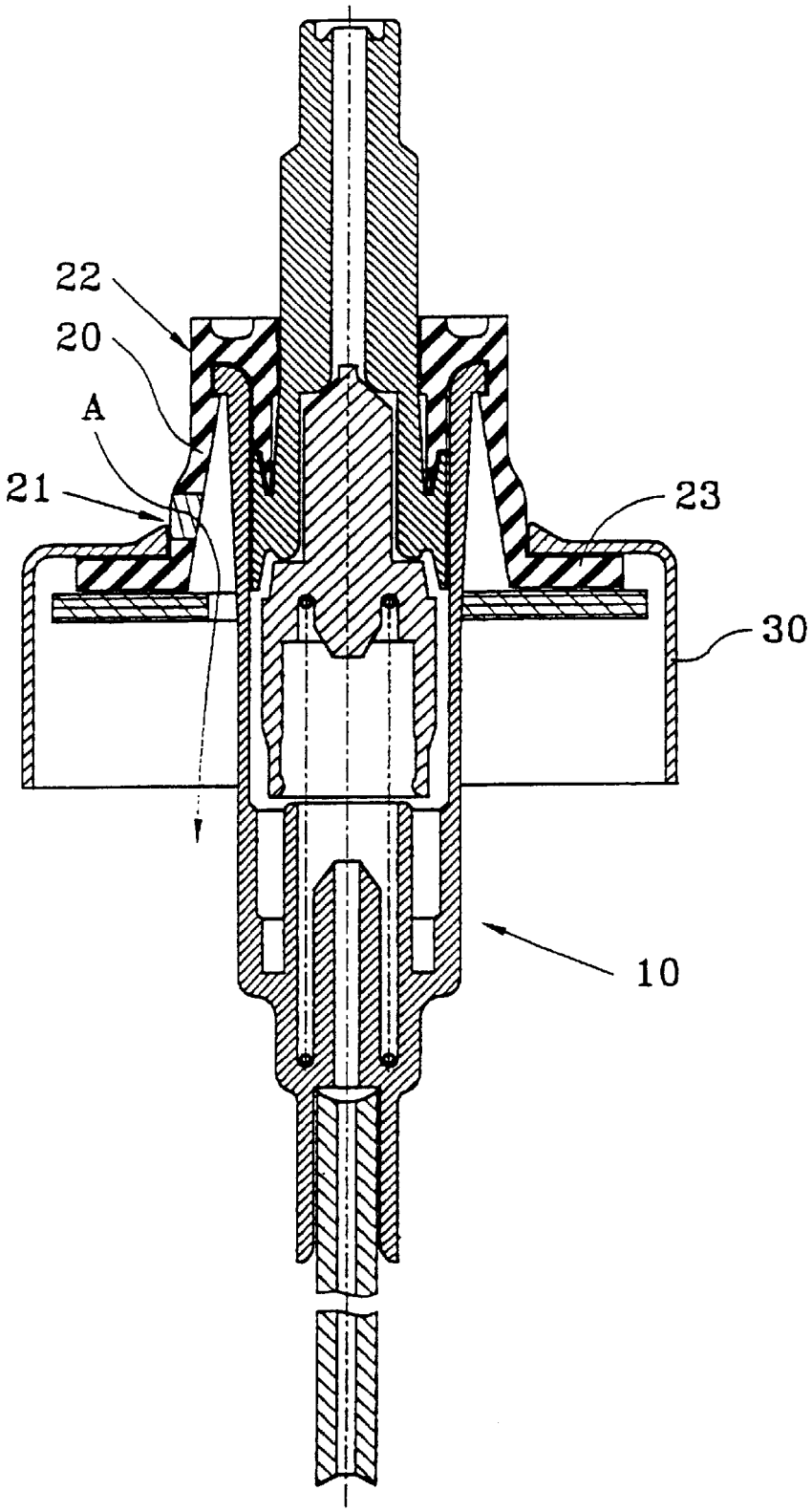
FIG. 3 is a view similar to FIG. 1 showing a third embodiment of a turret of the present invention.

With reference to the drawings, the fluid dispenser device comprises a fluid tank (not shown) which can be of arbitrary shape and made of any material, a dispenser member 10, in particular an airless pump, i.e. a pump that operates without air intake, and a turret 20 which supports and fixes said pump 10. The turret 20 is subsequently fixed to the neck of the tank by means of a fixing ring 30. In the embodiment shown in FIGS. 1 and 3, the turret 20 and the ring 30 are made in the form of two separate pieces, whereas in the embodiment shown in FIG. 2, the turret 20 and the ring 30 form a single piece. The fixing ring 30 can be any appropriate type, in particular of the type for snap-fastening (FIG. 1), for screw fastening (FIG. 2), or for crimping (FIG. 3). Naturally, the various types of fastening can be fitted to different embodiments of the turret of the invention, and the combinations shown in the drawings are merely particular examples. For example, the embodiment in which the turret 20 is made integrally with the fixing ring 30 (FIG. 2) can be used with any type of fastening.

Figure 1:
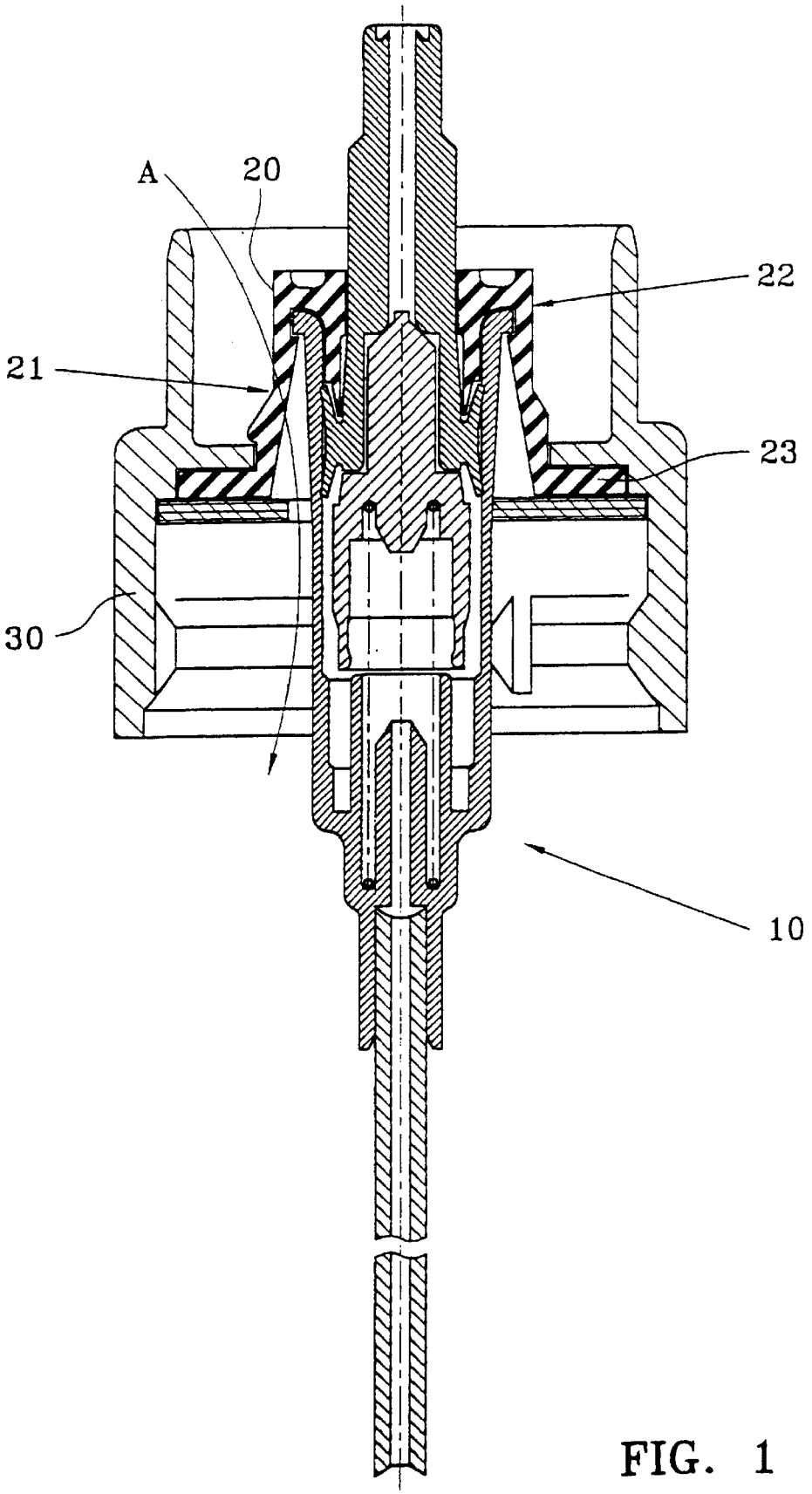
FIG. 1 is a diagrammatic view showing a first embodiment of a turret of the present invention.

In the invention, at least a portion 21 of the turret 20 is made of a plastics material that is permeable to air. Thus, after each use of the device, the suction created inside the tank can be compensated by a flow of air passing through said turret 20, as represented diagrammatically by arrow A in the figures. As can be seen in the figures, the portion 21 of the turret 20 through which the air passes is situated in the intermediate portion situated between the portion 22 of the turret 20 that supports the pump 10 and the portion 23 of the turret 20 which is fixed to the fixing ring 30. It is thus at least this portion 21 that needs to be made out of an air-permeable plastics material. FIG. 3 shows a turret 20 made of a non-permeable plastics material and having a window 21 overmolded therein, said window being made of the plastics material that is permeable to air. In a variant, it can be advantageous to make the entire turret 20 out of said material, as shown in FIGS. 1 and 2.

The invention thus enables a pump of conventional type to be used without any need to be modified, and also enables any known type of tank to be used which likewise does not need to be modified.

The only part that needs to be modified in fluid dispenser devices that are presently in use is said turret 20, which is a part of small dimensions and very easy to manufacture. By way of example, the turret can be manufactured by molding, in particular using an injection/blow molding method, or a dual injection method. A particularly advantageous characteristic of the invention is that said air-permeable turret of the present invention can be made in the same machine and/or the same mold as is used for making presently used turrets, merely by changing the plastics material that is fed to said machine.

The solution proposed by the present invention is thus particularly low cost and enables manufacture and assembly of the various parts constituting the dispenser device to be very simple and thus of very low cost, with no need to modify any of the machines in the assembly line.

In the invention, the air-permeable plastics material constituting said turret 20 can advantageously be constituted by thermoplastic polymers such as polyolefins, polyvinyl chloride (PVC), or engineering polymers, advantageously including a filler. The filler which is for increasing air diffusion can be constituted, in particular, by chalk, talc, or silicone.

The advantage of these plastics materials is that they are allow air to pass while retaining contaminating agents such as bacteria, thus making it possible to avoid spoiling the fluid contained in the tank.

Air-permeable plastics materials suitable for use in making the turret of the invention can be those used for making the walls of the flask in document EP-0 771 734. Consequently, that document is included in the present description by way of reference for this particular feature.

The present invention thus makes it possible to provide a solution that is particularly advantageous and low cost for resolving the problem which consists in avoiding contamination of the fluid contained in a dispenser device that operates with an airless pump.

What is claimed is:

1. A fluid dispenser device comprising:

a fluid tank;

a dispensing pump (10) operating without air intake; and a turret (20) supporting and fixing said pump (10), said turret being fixed on said tank by a fixing ring (30);

wherein at least a portion (21) of said turret (20) is made of a plastics material that is permeable to air.

2. A device according to claim 1, in which said turret (20) is made integrally with said fixing ring (30).

3. A device according to claim 1, in which the air-permeable plastics material allows air to pass to the inside of the tank but prevents the passage of bacteria.

4. A device according to claim 1, in which the air-permeable plastics material comprises thermoplastic polymers.

5. A device according to claim 1, in which the air-permeable plastics material includes a filler.

6. A device according to claim 5, in which the filler is chalk, talc, or silicone.

7. A device according to claim 1, in which said turret (20) has a window (21) of air-permeable plastics material, said window (21) being overmolded in said turret (20), a non-window portion of said turret being made of a material that is not permeable.

* * * * *